US005924921A

United States Patent [19]

Yang

[11] Patent Number: 5,924,921

[45] Date of Patent: Jul. 20, 1999

[54] APPARATUS FOR STORING VOLATILE CHEMICALS

[75] Inventor: Vince W. H. Yang, Hsinchu, Taiwan

[73] Assignee: Vanguard International Semiconductor Corporation, Hsinchu, Taiwan

[21] Appl. No.: 08/978,842

[22] Filed: Nov. 26, 1997

[51] Int. Cl.[6] ..... A47B 77/06; F24F 7/00

[52] U.S. Cl. ..... 454/253; 312/213; 312/229; 454/57

[58] Field of Search ..... 312/213, 229; 454/56, 57, 253; 109/14

[56] References Cited

U.S. PATENT DOCUMENTS 5,056,422 10/1991 Horntvedt ..... 454/57
5,407,389 4/1995 Poblete et al. ..... 454/56
5,570,939 11/1996 Scott ..... 312/229
5,779,537 7/1998 Alden ..... 454/253 X

*Primary Examiner*—Harold Joyce
*Attorney, Agent, or Firm*—Christensen O'Connor Johnson & Kindness PLLC

[57] ABSTRACT

A ventilated cabinet apparatus for the storing of volatile chemicals. This apparatus is a ventilated cabinet for the storing of volatile or poisonous chemicals utilizes a vacuum pump drawing air out of the back of the cabinet to disperse the volatile gases or poisonous gases. In addition, the ventilated cabinet has holes running from front to back within the walls of the cabinet to allow fresh outside air to flow through the cabinet. Thus, any volatile gas buildup from the chemicals in the apparatus will be dissipated.

23 Claims, 7 Drawing Sheets

APPARATUS FOR STORING VOLATILE CHEMICALS

FIELD OF THE INVENTION

The present invention relates to an apparatus for storing volatile chemicals and, more particularly, to a ventilated cabinet for storing volatile chemicals.

BACKGROUND OF THE INVENTION

A large amount of chemicals are used in semiconductor processes. Many of these chemicals are volatile, flammable, explosive, or toxic. Examples include acetone, isopropanol, and organic photoresist. In a typical semiconductor foundry, these chemicals are stored in vented cabinets in order to prevent the volatile gases or poisonous gases from leaking outside. Unfortunately, the prior art approach to this problem was to simply have a vented cabinet. However, it was found that a simple vent was not sufficient to fully disperse the volatile gases. The outflow of the toxic gases is dangerous to human body and great hazardous might be generated with the presentation of volatile and flammable gases. Conventional simple vent is unable to exhaust enough volatile gases inside the cabinet and the accumulation of highly volatile gases may cause the inner explosion of the cabinet. Thus the aforementioned cabinet is unacceptable with storing the toxic and explosive chemicals. A cabinet for storing the dangerous chemicals is needed for safety considerations.

SUMMARY OF THE INVENTION

In accordance with this invention, an apparatus for storing volatile chemicals is disclosed. In one embodiment, the apparatus includes several primary components: a cover of generally cubic shape having a back wall, top and bottom walls, side walls, and an open front wall, the cover includes a plurality of ventilation holes bored through at least one wall of the cover from the back wall to the open front wall, the ventilation holes are distributed around the inner peripheral of the cover for sucking the fresh air outside; a door secured to the cover, the door sized to cover the open front wall when in a closed position and to define an inner storage space and to provide an opening for conveying chemicals; at least one storing means supported by and within the cover to support the volatile chemicals; and exhaust means connected to the cover for exhausting gases within the cover, the exhaust means working to draw air out from the inner storage space and through the ventilation holes.

With the ventilation cabinet in the present invention, highly volatile, flammable, explosive, and toxic gases can be stored safely. The outflow of toxic and flammable gases can be eliminated. The continuous sucking of gases inside the cabinet through a vacuum pump or equivalent means prevents the accumulation of explosive gases inside. The danger of inner explosion can be erased.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
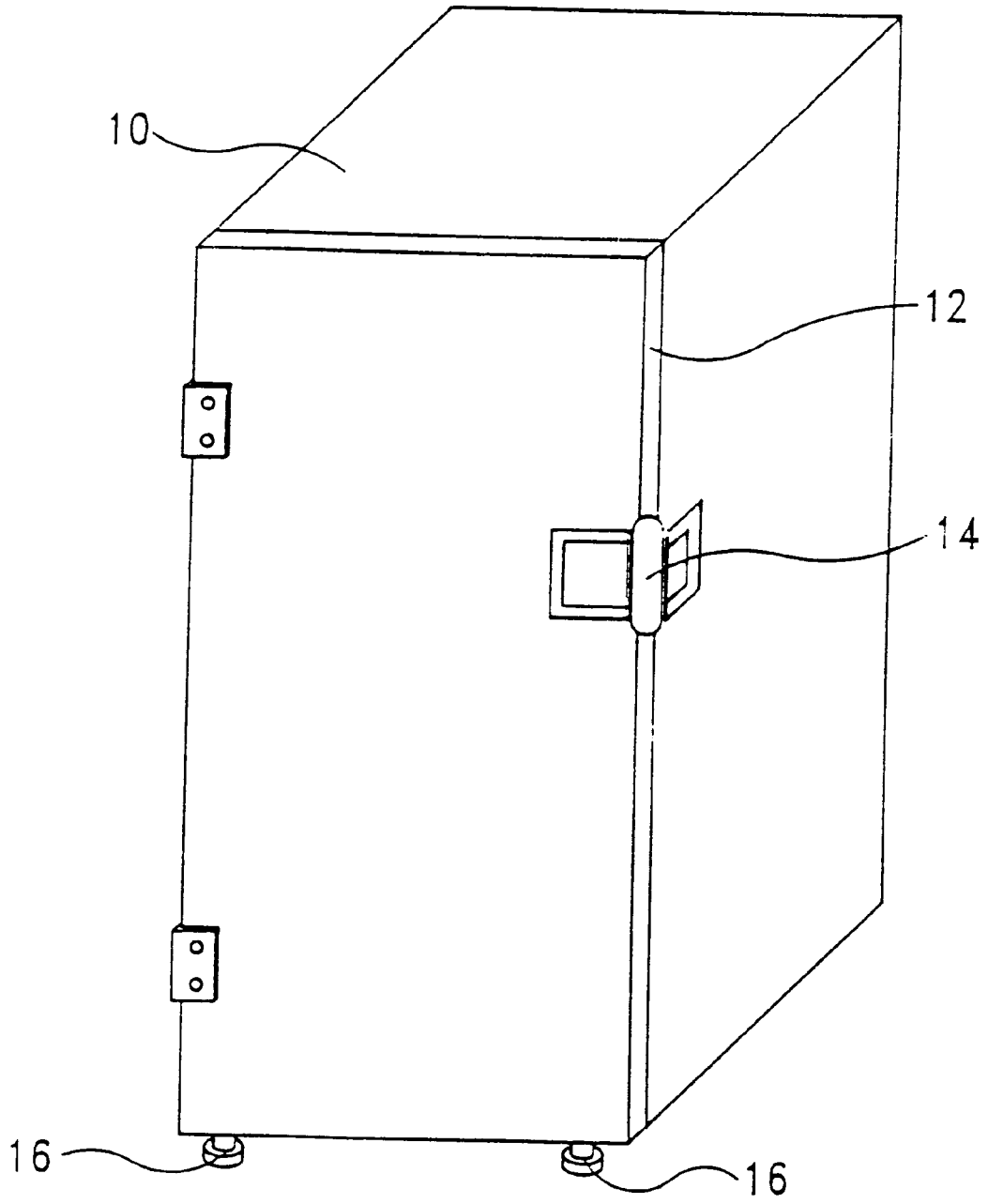
FIG. 1 shows the front view of a storage apparatus formed in accordance with this present invention.

FIG. 1 shows the front view of a storage apparatus formed in accordance with the present invention. The apparatus of this invention is a ventilated cabinet. The apparatus has a cover 10 for the main body of this apparatus. Usually, the cover 10 is a metal cubic shell. In this embodiment, the cover 10 is a double thickness cover and is made of stainless steel. There are four supporters 16 on the bottom of the cover 10. The four supporters 16 are for supporting the cover 10 in order to suspend the cover 10 off of the ground. A door 12 is located on the front side of the cover 10. The door 12 has the same width and height with the cover means 10 so as to completely enclose the cubic area defined by cover 10. In addition, a lock 14 is provided on the door 12. In this embodiment, the door 12 is a double thickness structure.

Figure 2:
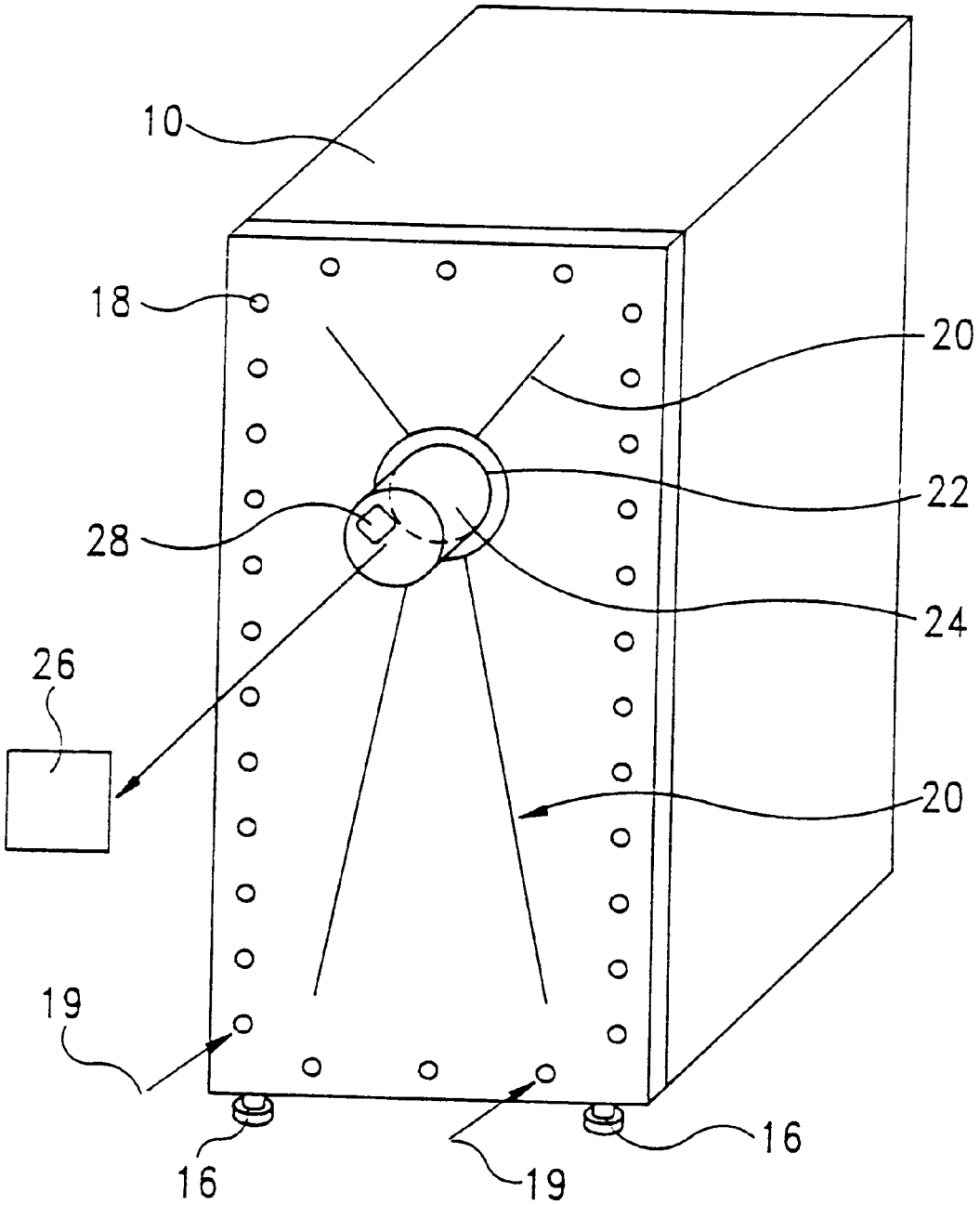
FIG. 2 shows the back view of the apparatus formed in accordance with this present invention.

FIG. 2 shows the back view of the apparatus formed in accordance with the present invention. The backside of the cover 10 is provided with two types of ventilation features, namely an outlet 22 and ventilation holes 18. The ventilation holes 18 are located on the back wall of the cover 10 around the periphery of the back wall. These holes are drilled or bored into the top, bottom, and side walls of the cover 10. Therefore, the ventilation holes form cylindrical tubes from the back wall to the front of the cover 10. This allows outside air to flow in (indicated by arrows 19). In this embodiment, the ventilation holes 18 are drilled in the top, bottom, and side walls of the cover 10 of the apparatus and extend all the way through to near the front door 12.

Figure 3:
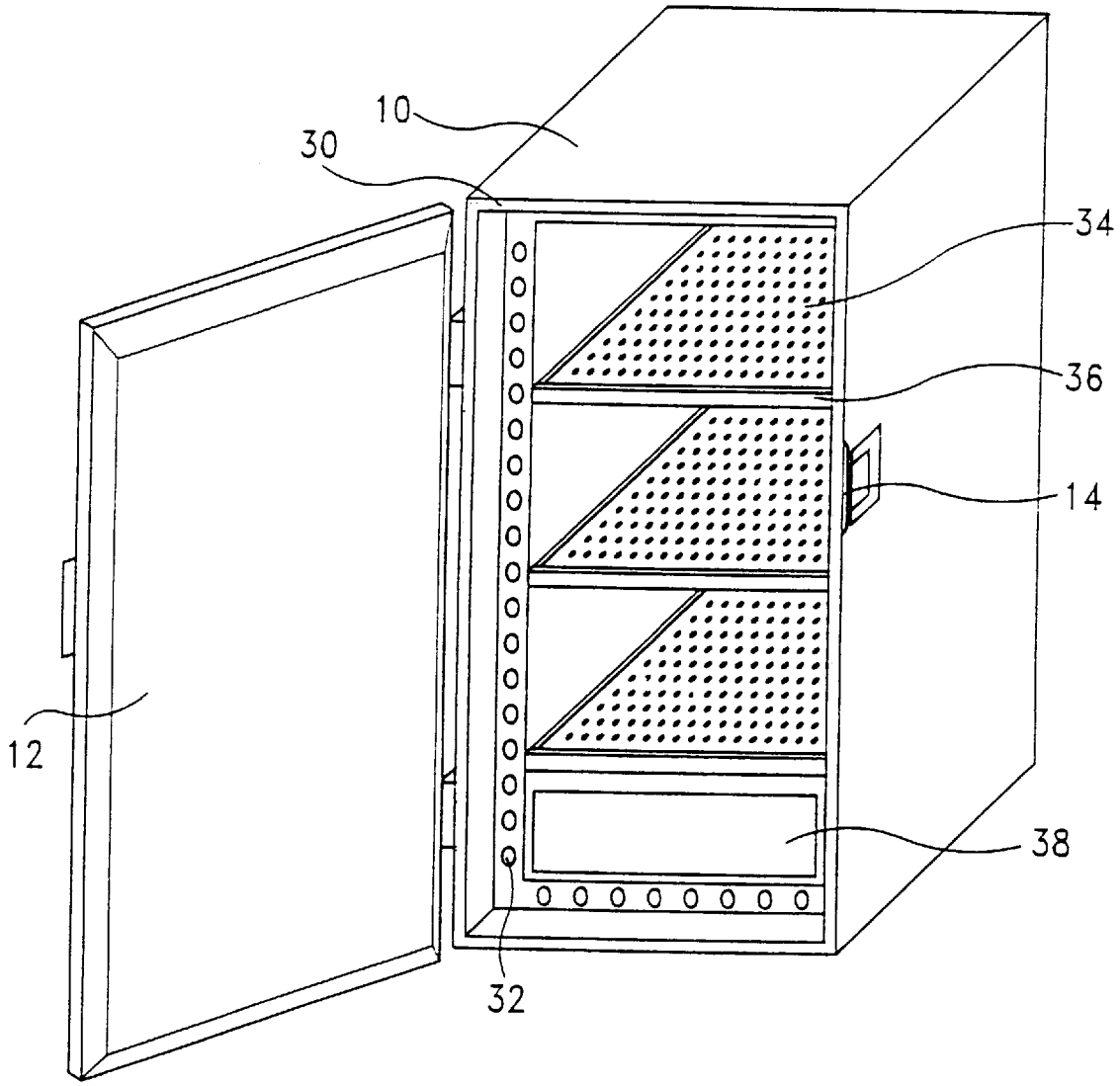
FIG. 3 shows the front view of the inside part of the apparatus formed in accordance with this present invention.

Turning now to FIG. 3, the ventilation holes 18 terminate at hole termination 32. In addition, the interior walls of the frontal area of cover 10 is recessed. This allows hold termination 32 to be unobstructed when door 12 is closed. Thus, throughout the entire frontal periphery of the cover 10, the inner portion of the walls are recessed.

Figure 8:
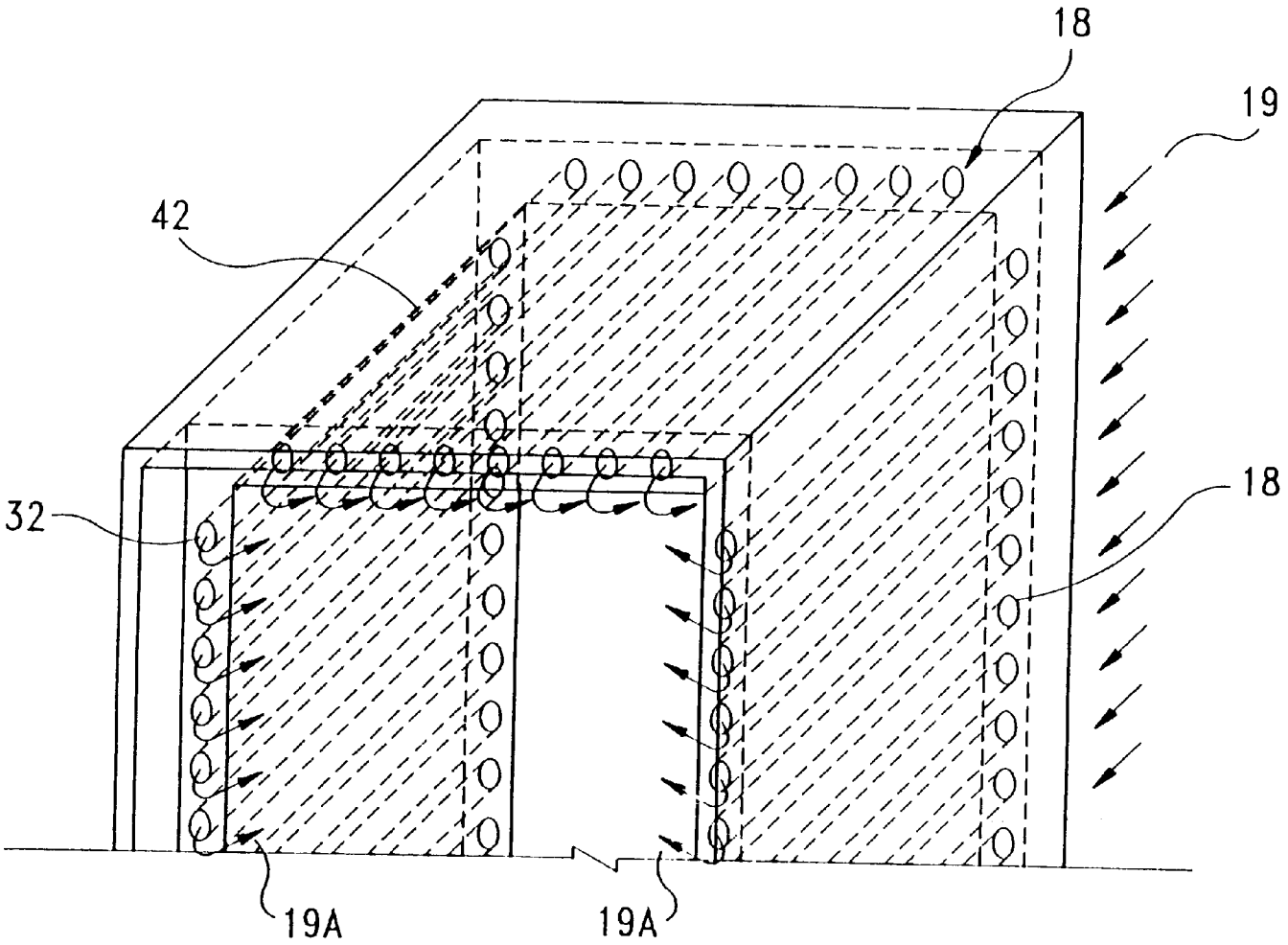
FIG. 8 is perspective view of the air holes of the apparatus formed in accordance with this present invention.

The resultant airflow is shown in FIG. 8. The ventilation holes 18 allow fresh outside air (indicated by arrows 19) to flow through the holes (indicated by the dashes 42) through hole termination 32 into the front of the apparatus.

Returning to FIG. 2, the outlet 22 allows for the extraction of gases contained in the apparatus. The outlet 22 is connected to vacuum means 26 via a pipe 24. The vacuum means 26 draws air out of the back of the apparatus via the pipe 24. In this embodiment, the outlet 22 is a round hole. In addition, the pipe 24 can be made of any suitable material, such as Teflon. In this embodiment, vacuum means 26 can be a vacuum pump or a center vacuum system. Furthermore, there are four anti-stress lines 20 around the outlet 22 in the back wall of the cover means 10. In addition, there is provided a pressure detector 28 located in the pipe 24 around the outlet 22. The pressure detector 28 is used to detect the pressure in the apparatus. The pressure detector 28 further comprises a alarm. In general, the pressure condition in the apparatus should optimally be a negative pressure condition. This indicates that air is flowing out through the outlet 22 and air is flowing in ventilation holes 18. When the pressure detector 28 detects that the pressure condition in the apparatus is positive, the pressure detector 28 will give an alarm. In this embodiment, the pressure detector 28 can be any suitable pressure detector.

Returning to FIG. 3, the front view of the inside part of the apparatus with the door 12 open is shown. As seen hole termination 32 are shown throughout the periphery of the front side of cover 10. Indeed, there is a one-to-one correspondence between a hole termination 32 and a ventilation hole 18. Further, as alluded to above, there is a recess space between the hole termination 32 and the door 12 when closed. This allows air to be freely introduced air into the apparatus. The air then flows through the apparatus and is drawn out by the vacuum means 26 as shown in FIG. 8.

Further, there is an O-ring 30 on the cover 10, as shown in the dots distribution region in FIG. 3, between the conjunction of the cover 10 and door 12 when the door 12 is closed. The O-ring 30 is a conventional O-ring that is used to seal the door 12 and cover 10 (when closed) to prevent gas leakage. After the door 12 is closed, the only interaction between the apparatus and the outside is via the ventilation holes 18. In this embodiment, the O-ring 30 can be formed from any suitable soft materials for providing tightness like rubber or plastic resin.

Figure 4:
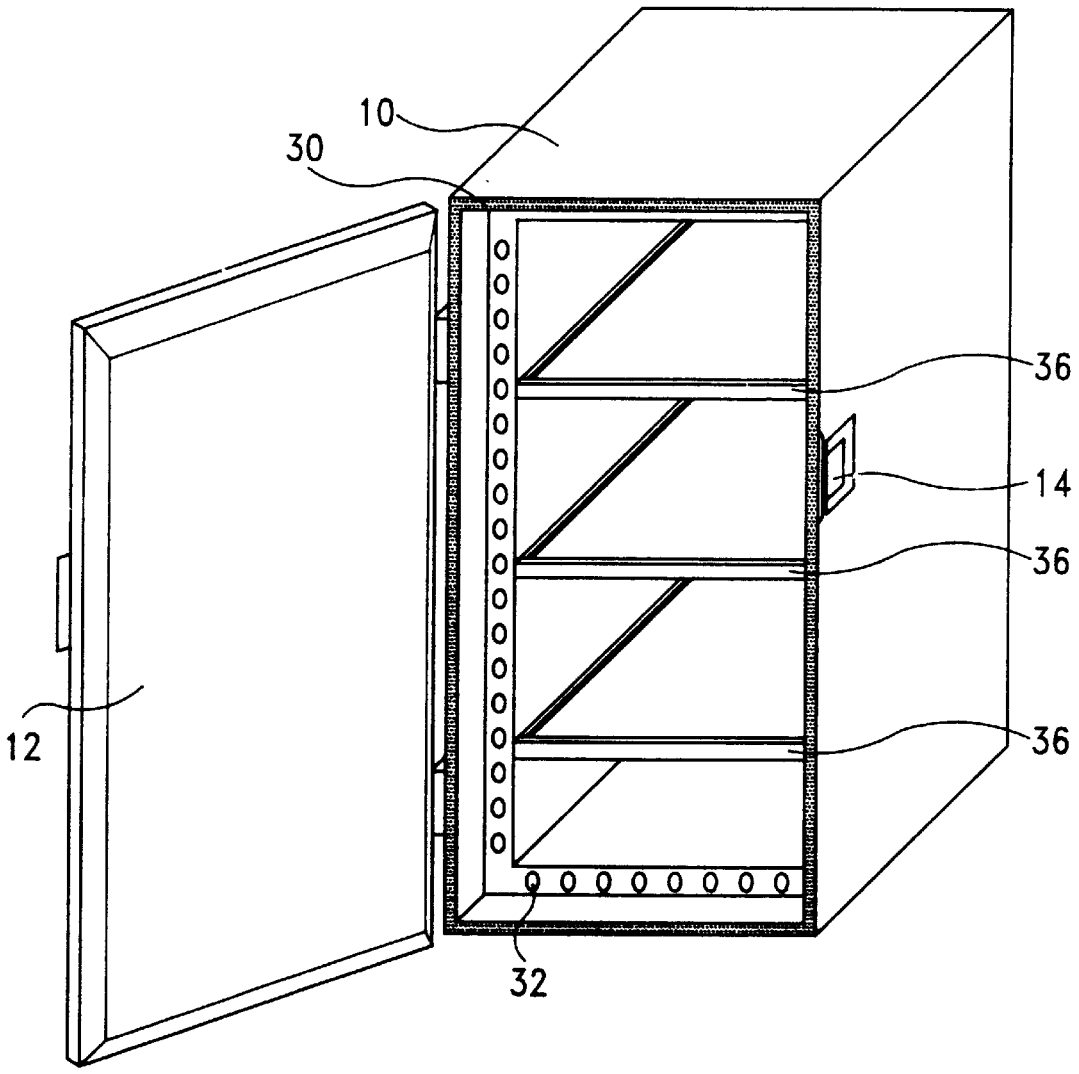
FIG. 4 shows the front view of the inside storing means of the apparatus formed in accordance with this present invention.
Figure 5A:
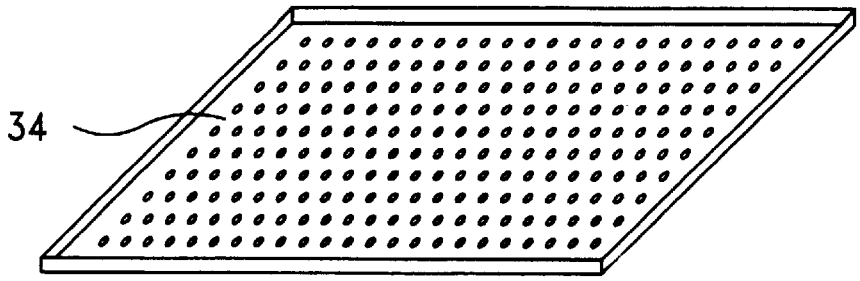
FIG. 5A is the structure of the top mesh layer of the apparatus formed in accordance with this present invention.
Figure 5B:
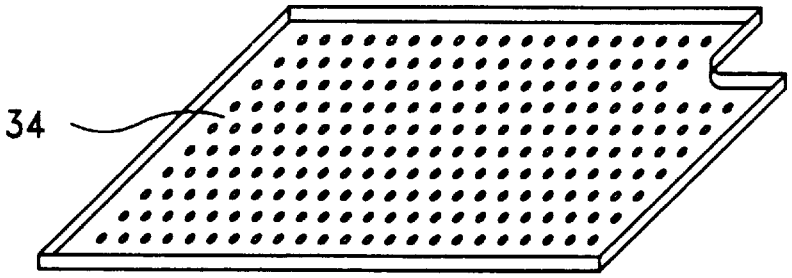
FIG. 5B is the structure of the mesh layer of the apparatus formed in accordance with this present invention.
Figure 6:
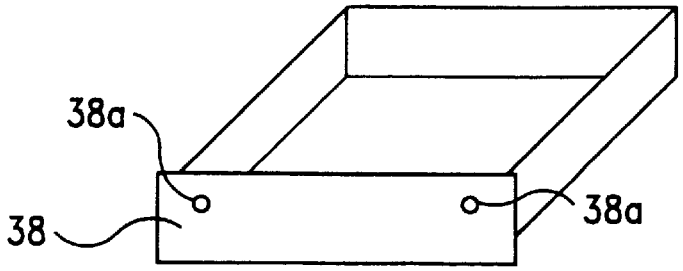
FIG. 6 shows the structure of the storing tank of the apparatus formed in accordance with this present invention.

Further, a plurality of storing means 36 (shown in FIG. 5A and FIG. 5B) are horizontally placed within the cover 10 to separate the encapsulated space into several storage subspaces. The storing means 36 are supported by the frames on the inner side walls of the cover 10 by any suitable means. FIG. 4 shows the structure of the frame of the storing means 36. It should be noted that the storing means 36 should be sized such that a small distance between the back wall and the door 12 is present. This allows for the free flow of air. In this embodiment, the frame of the storing means can be made of metals like stainless steel. Each storing means 36 can include a mesh layer 34 placed upon. Thus, if the liquid chemicals are spilled, the spilling liquid will drop through the mesh layer 34 and be collected. Referring to FIG. 6, an reservoir 38 is located on the bottom of the cover 10. The reservoir 38 is for collecting spilled chemicals and should from time to time be emptied. Two holes 38*a* can be placed on the front side wall of the reservoir 38 for balancing the pressure between the inside of the reservoir 38 and the cover 10. In this embodiment, the mesh layer 34 and the reservoir 38 are removable and can be drawn out for cleaning. The structure of the mesh layer 34 are shown in FIG. 5A as an example of the top mesh layer in the embodiments. FIG. 5B shows an example of the mesh layer at other storage level in the embodiments, which has an opening at the corner for providing a space for a collecting pipe.

Figure 7:
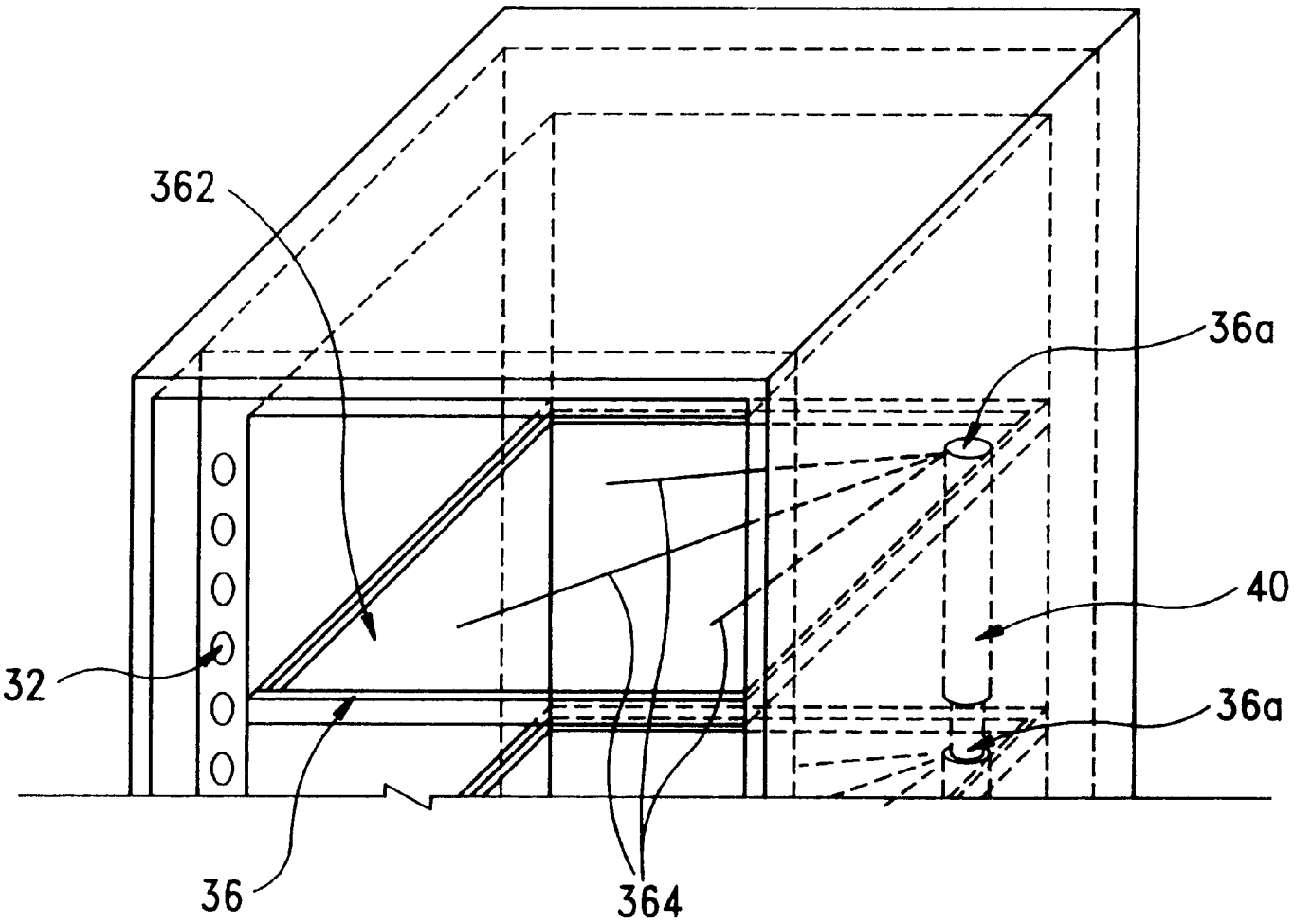
FIG. 7 is a perspective view of the inside part of the apparatus formed in accordance with this present.

FIG. 7 is a perspective view of the inner part of an alternative embodiment of the apparatus. From FIG. 7, each storing means 36 has a liquid collecting surface 362. The liquid collecting surface 362 are formed with a lowest point 362*a*. Any points on the liquid collecting surface has a relative height difference to point 362*a* thus the spilled liquid can be collected. The collecting pipe 40 is located at a lowest point 36*a*, as a outlet of the liquid collecting surface 362 for exhausting the liquid. There are several introducing liquid lines 364 formed on the liquid collecting surface 362 to help the spilled liquid move toward the collecting pipe 40 which stands in one corner of the cover 10. The collecting pipe 40 is also placed under each outlet 36*a* of the liquid collecting surface 362. The outlet 36*a* is designed to be smaller than the diameter of the collecting pipe 40 and the spilled liquid can flow through the collecting pipe 40 to the reservoir 38 located in the bottom of the cover 10. With the ventilation cabinet in the present invention, highly volatile, flammable, explosive, and toxic gases can be stored safely. The outflow of toxic and flammable gases can be eliminated. The continuous sucking of gases inside the cabinet through a vacuum pump or equivalent means prevents the accumulation of explosive gases inside. The danger of inner explosion can be erased.

Although specific embodiment has been illustrated and described, it will be obvious to those skilled in the art that various modifications may be made without departing from the which is intended to be limited solely by the appended claims.

The embodiments of the invention in which an exclusive property or privilege claimed are defined as follows:

1. An apparatus for storing volatile chemicals, said apparatus comprising:

a cover of generally cubic shape having a back wall, top and bottom walls, side walls, and an open front wall, said cover including a plurality of ventilation holes bored through at least one wall of said cover from said back wall to said open front wall;

a door secured to said cover, said door sized to cover said open front wall when in a closed position and to define an inner storage space;

at least one storing means supported by and within said cover to support said volatile chemicals; and exhaust means connected to said cover for exhausting gases within said cover, said exhaust means working to draw air out from said inner storage space and through said ventilation holes.

2. The apparatus of claim 1, further including pressure detecting means located on said exhaust means for detecting the pressure in said inner storage space.

3. The apparatus of claim 2, wherein said pressure detecting means further includes an alarm.

4. The apparatus of claim 1, wherein said at least one storing means has an outlet for collecting an amount of spilled liquid from said volatile chemicals.

5. The apparatus of claim 1, further including a reservoir located adjacent to the bottom wall of said cover for storing spilled volatile chemicals.

6. The apparatus of claim 5, further including at least one collecting pipe located adjacent to the back wall of said cover and under said at least one storing means for guiding an amount of spilled liquid to the said reservoir.

7. The apparatus of claim 5, wherein said reservoir has at least one hole located on a front side wall of said reservoir, for balancing a pressure difference between said reservoir and said cover.

8. The apparatus of claim 1, wherein said door further includes a lock.

9. The apparatus of claim 1, wherein said front wall of said cover includes an O-ring located on the conjunction between said cover and said door when said door is in the closed position.

10. The apparatus of claim 1, wherein said pluralities of storing means has a mesh layer formed upon.

11. The apparatus of claim 1, wherein said exhaust means comprises:

an outlet located on the back wall of said cover;

a pipe connected to said outlet; and vacuum means, wherein said vacuum means connects to the other side of said pipe, wherein said vacuum means is for withdrawing gases from said inner storage space.

12. The apparatus of claim 8, wherein said vacuum means comprises a vacuum pump.

13. The apparatus of claim 8, wherein said vacuum means comprises a center vacuum system.

14. An apparatus for storing volatile chemicals, said apparatus comprising:

cover means, wherein said cover means is a cubical having an opening face;

door means, wherein said door means is adapted to mate with said opening face of said cover means in order to provide a space to store said volatile chemicals;

at least one storing means, wherein said storing means is supported by said cover and separates said space for storing said volatile chemicals;

a plurality of ventilated means located within walls of said cover and extending from the back wall of said cover to the opening face of said cover;

outlet means located on the back wall of said cover means;

pipe means connected to said outlet means;

vacuum means connected to the other side of said pipe means, wherein said vacuum means is for withdrawing air from said space;

reservoir located in the bottom of said cover for collecting an amount of spilled volatile chemicals; and pressure detecting means located on said pipe means for detecting the pressure in said space.

15. The apparatus of claim 14, further including a lock coupled to said door.

16. The apparatus of claim 14, wherein said at least one storing means has an outlet for collecting an amount of spilled liquid from said volatile chemicals.

17. The apparatus of claim 16, further including at least one collecting pipe located adjacent to the back wall of said cover and under said outlet for guiding an amount of spilled liquid to the said reservoir means.

18. The apparatus of claim 14, wherein said reservoir has at least one hole located on a front side wall of said reservoir, for balancing a pressure difference between said reservoir means and said cover means.

19. The apparatus of claim 14, wherein said cover means further includes an O-ring located on the conjunction between said cover means and said door means.

20. The apparatus of claim 14, wherein said pluralities of storing means has a mesh layer formed upon.

21. The apparatus of claim 14, wherein said vacuum means comprises a vacuum pump.

22. The apparatus claim 14, wherein said vacuum means comprises a center vacuum system.

23. The apparatus according to claim 14, wherein said pressure detecting means further includes an alarm.

* * * * *